United States Patent [19]

Herzog

[11] Patent Number: 5,035,270

[45] Date of Patent: Jul. 30, 1991

[54] AUTOMATIC CONVEYORIZED CONTAINER FILLER

[76] Inventor: Kenneth J. Herzog, 200 Mill Rd., Riverhead, N.Y. 11901

[21] Appl. No.: 433,114

[22] Filed: Nov. 8, 1989

[51] Int. Cl.[5] ..... B65B 3/12

[52] U.S. Cl. ..... 141/116; 141/177; 141/180; 141/181; 141/188; 141/258; 141/261; 222/309; 222/494; 92/13

[58] Field of Search ..... 141/115-117, 141/119, 120, 126, 127, 177, 180, 181, 188, 261, 258, 266, 263, 264, 251, 138, 140-143, 155-157, 159-161, 178; 222/282, 283, 309, 494; 92/13, 13.4, 13.5, 13.8

[56] References Cited

U.S. PATENT DOCUMENTS

| | | | |
|---|---|---|---|
| 2,684,805 | 7/1954 | McBean | 141/116 X |
| 2,978,149 | 4/1961 | Rosen | 141/116 X |
| 3,139,915 | 7/1964 | Minard | 141/160 |
| 3,174,649 | 3/1965 | Richardson | 222/309 X |
| 3,227,325 | 1/1966 | Bates | 222/309 |
| 3,237,661 | 3/1966 | Rosen | 141/180 |
| 3,424,209 | 1/1969 | Settembrini | 141/180 |
| 3,489,186 | 1/1970 | Riker | 141/141 |
| 3,655,301 | 4/1972 | McClung | 92/13.8 X |
| 3,789,889 | 2/1974 | Riedel et al. | 141/140 |
| 3,831,821 | 8/1974 | Doyen | 141/261 X |
| 4,000,765 | 1/1977 | Lydiksen | 141/181 |
| 4,004,620 | 1/1977 | Rosen | 141/138 |
| 4,043,709 | 8/1977 | Grevich | 92/13.5 X |
| 4,056,043 | 11/1977 | Sriramamurty et al. | 92/13.2 |
| 4,227,627 | 10/1980 | Bennett | 222/282 |
| 4,228,924 | 10/1980 | Gilbert | 222/309 X |
| 4,273,261 | 6/1981 | Krueger | 222/309 X |
| 4,359,075 | 11/1982 | Eberle et al. | 141/177 |

FOREIGN PATENT DOCUMENTS

| | | | |
|---|---|---|---|
| 0555583 | 9/1957 | Belgium | 92/13 |

*Primary Examiner*—Henry J. Recla
*Assistant Examiner*—Casey Jacyna

[57] ABSTRACT

An automatic conveyorized volumetric container filler is provided and consists of a mechanism to pump a predetermined amount of fluid from a reservoir into containers by using volumetric piston pumps operated by a pump drive cylinder. The containers are automatically conveyed to a plurality of filling nozzles for receiving the fluid therefrom so that after the containers are filled, they can be conveyed away to be capped.

4 Claims, 4 Drawing Sheets

AUTOMATIC CONVEYORIZED CONTAINER FILLER

BACKGROUND OF THE INVENTION

The instant invention relates generally to container filling machines for liquids of all viscosities and more specifically it relates to an automatic conveyorized volumetric container filler.

Numerous container filling machines have been provided in prior art that are adapted to supply fluids into containers before the containers are capped. While these units may be suitable for the particular purpose to which they address, they would not be as suitable for the purposes of the present invention as heretofore described.

SUMMARY OF THE INVENTION

A primary object of the present invention is to provide an automatic conveyorized volumetric container filler that will overcome the shortcomings of the prior art devices.

Another object is to provide an automatic conveyorized volumetric container filler which will automatically fill a plurality of containers carried on a conveyor by a matching set of filling nozzles.

An additional object is to provide automatic conveyorized volumetric container filler in which each filling nozzle is a closed tip positive cut-off spring return no drip poppet type.

A further object is to provide an automatic conveyorized volumetric container filler that is simple and easy to use.

A still further object is to provide an automatic conveyorized volumetric container filler that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
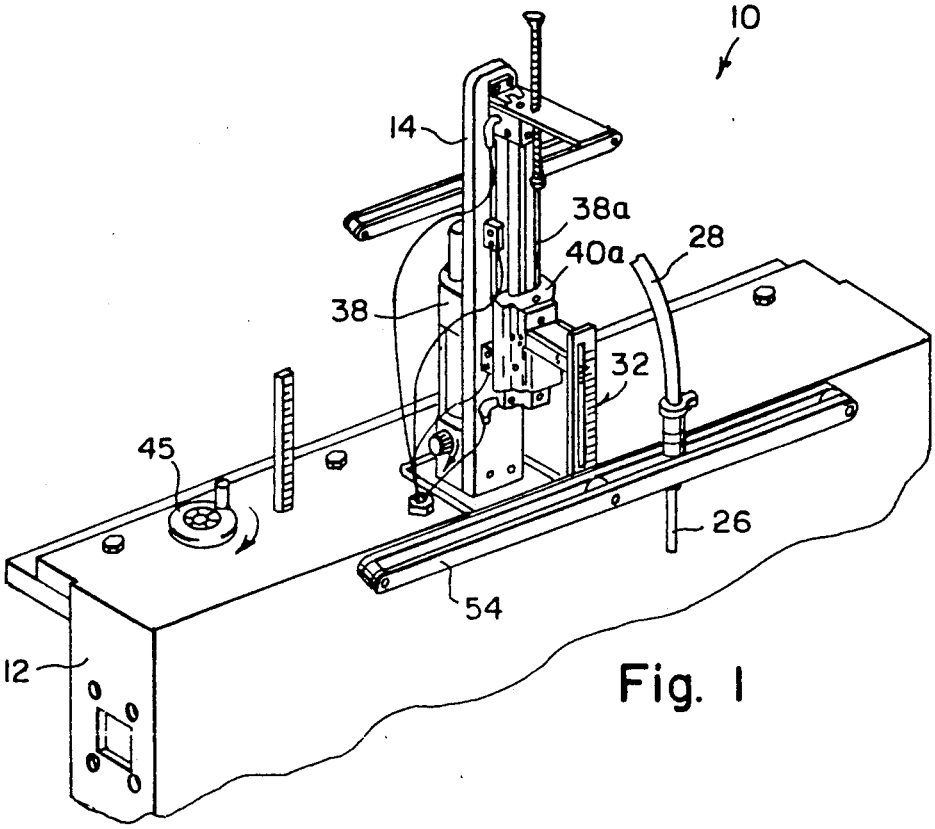
FIG. 1 is a perspective view of the invention.
Figure 7:
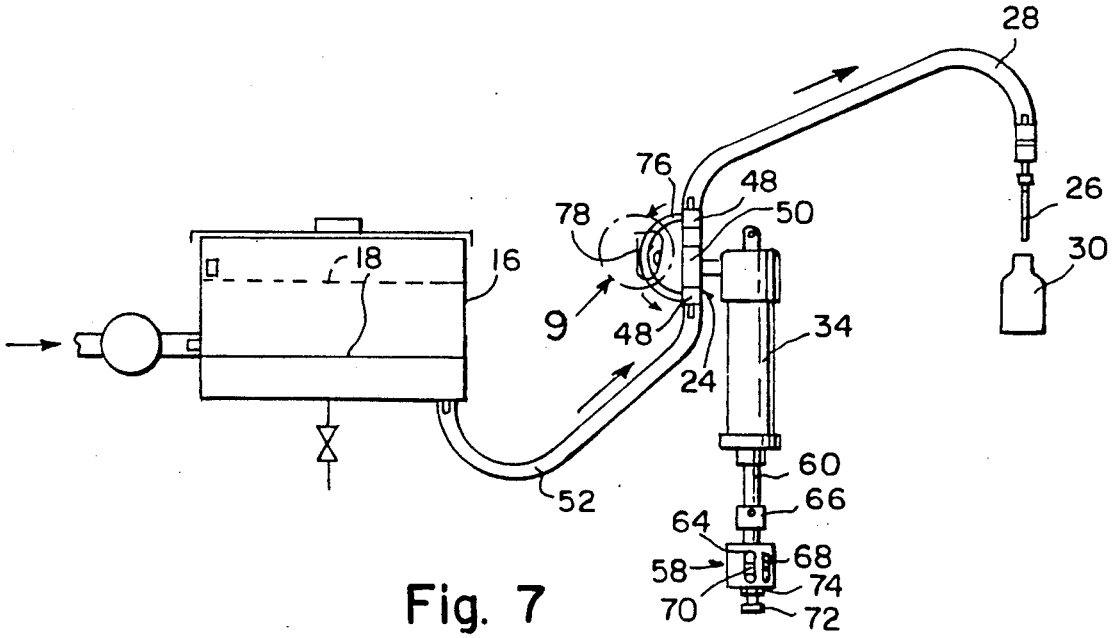
FIG. 7 is a flow diagram.
Figure 2:
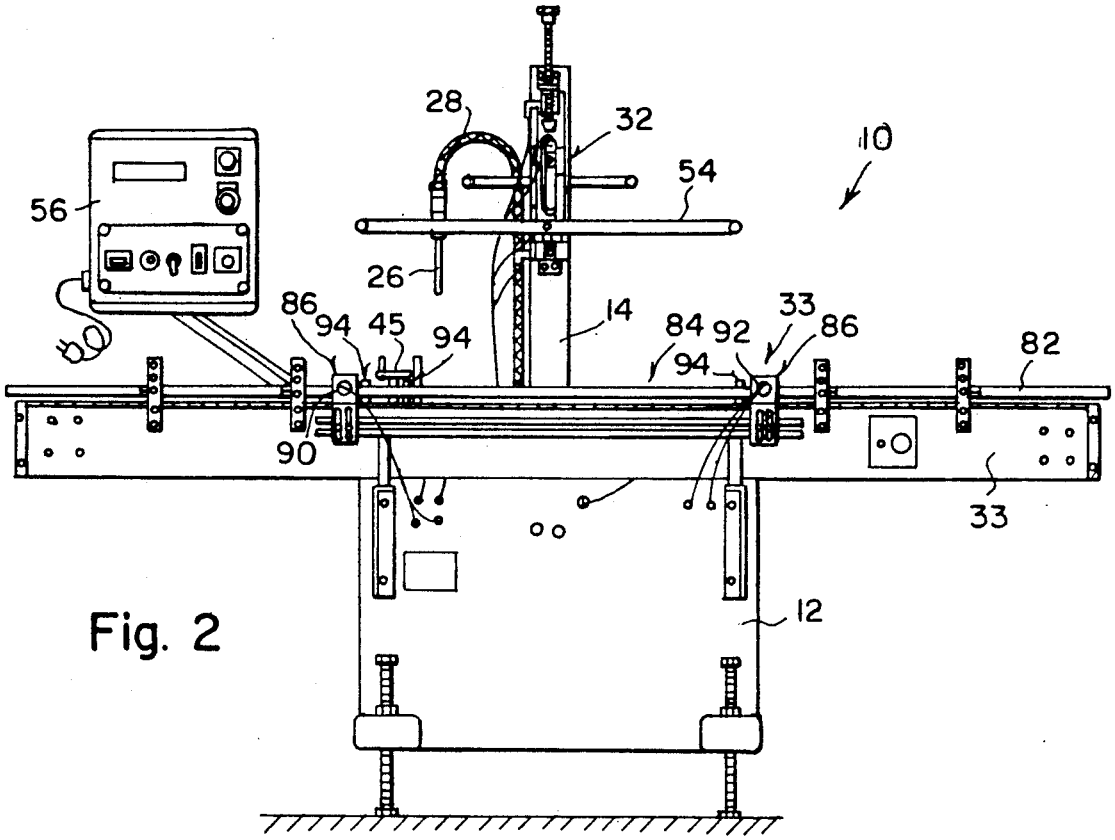
FIG. 2 is a front view of the invention.
Figure 3:
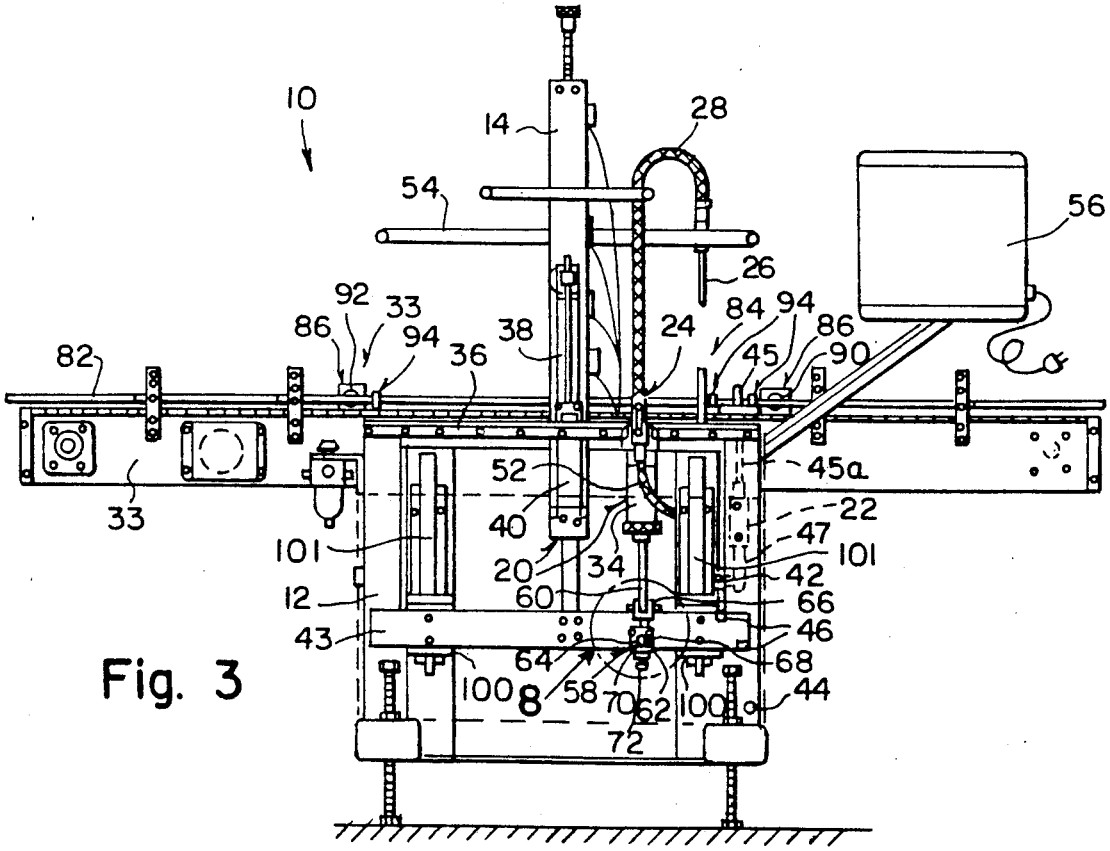
FIG. 3 is a rear view of the invention.

Turning now descriptively to the drawings, in which similar reference characters denote similar elements throughout the several views, the Figures illustrate an automatic conveyorized volumetric container filler 10 that includes a base member 12 with a vertical stanchion 14 thereon. A reservoir 16 with fluid 18 therein sits behind or near the base member 12. A first structure 20 is for pumping the fluid 18 out of the reservoir 16 while a second structure 22 is for controlling volume of the fluid 18 pumped. A third structure 24 is for preventing backflow of the fluid 18 into the reservoir 16. A filling nozzle 26 is fluidly connected via a pump discharge tube 28 to the backflow preventing structure 24. A container 30 is for receiving the fluid 18 from the filling nozzle 26. A fourth structure 32 is for controlling height of the filling nozzle 26 to compensate for varying heights of the container 30. A fifth structure 33 is for automatically conveying a plurality of the containers 30 to a plurality of the filling nozzles 26 for receiving the fluid 18 therefrom, so that after the containers 30 are filled, they can be conveyed away to be capped or sealed.

The pump driving structure 20 includes a volumetric piston or pumps 34 suspended on the base member 12 by a mounting arm 36. A pump drive cylinder 40 is directly mounted to the volumetric piston pump 34 by way of a common drive bar 43 which can accept one to thirty six volumetric piston pumps 34 simply by bolting them between the mounting arm 36 and the rod end 60 onto the common drive bar. The common drive bar 43 is bolted to linear bearings 100 on two ends which in turn pass around hardened support vertical guide shafts 101 which are bolted to the interior (back wall) of the base member 12. The pump drive hydraulic flow controller 38 is vertically suspended above the pump drive cylinder 40. A piston, not shown, is pneumatically reciprocated in the pump drive cylinder 40 by pneumatically forcing oil in either direction through the hydraulic flow controller 38 to control the speed and consistency of rate of the pump drive cylinder 40 and ultimately the motion of the common drive bar 43.

The volume controlling structure 22 includes a pair of spaced apart sensor switches 42 and 44 mounted onto said base member 12, in which the top sensor switch 42 is adjustable with respect to the bottom sensor switch 44. A pair of spaced apart actuators 46 are carried on the common drive bar 43 to activate the sensor switches 42 and 44 so as to limit stroke of the pump drive cylinder 40. Hand wheel 45 operates adjusting screw **45*a* that is threaded into a bracket 47 which is reciprocated by turning the hand wheel 45 to move sensor switch 42. A stanchion 14 is bolted onto the hydraulic flow controller 38 and supports the nozzle rack drive cylinder 38*a*. The backflow preventing structure 24 includes a pair of check valves 48 within a tee fitting 50 on upper end of the volumetric piston pump 34 that is connected to a pump intake tube 52 extending upwardly from the reservoir 16**.

The height controlling structure 32 includes a vertical adjustable nozzle rack 54 mounted to slide mount **40*a* operated from nozzle rack vertical drive cylinder 38*a* on one side of the stanchion 14 opposite the pump drive cylinder 38, for holding the filling nozzle 26. Nozzle rack drive cylinder 38*a* allows for the nozzle rack 54 to slide up and down vertically such that the filling nozzle 26 will enter the container 30 and rise up slowly while the volumetric piston pump 34 is pumping. This will give a bottom up fill or rising fill. A control box 56 is also provided for electrically operating the drive cylinders 40 and 38***a*, the sensors 42 and 44 and a programmable controller etc. (not shown).

Figure 8:
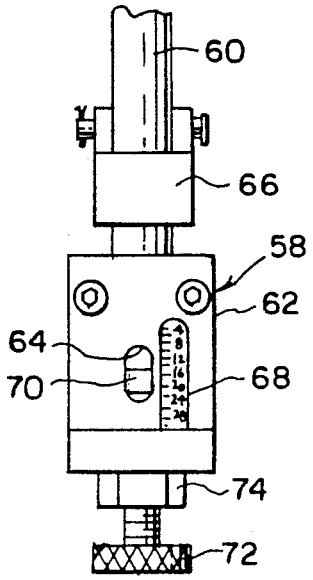
FIG. 8 is an enlarged elevational view of the fine tuning adjustment assembly as indicated by numeral 8 in FIG. 3.
Figure 10:
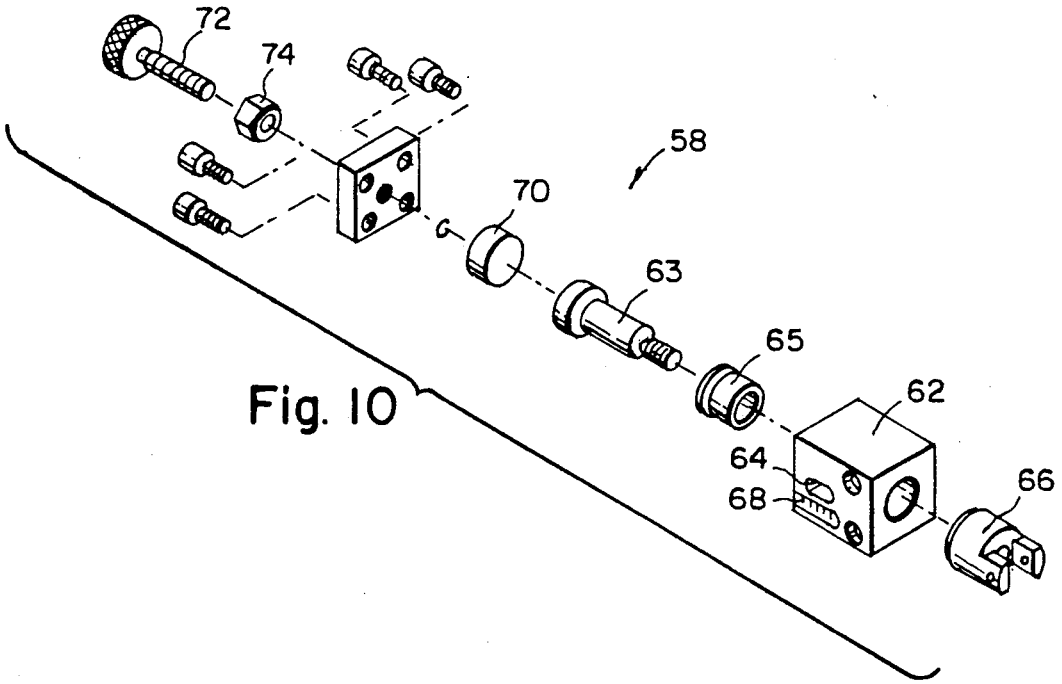
FIG. 10 is an exploded perspective view of the fine adjustment assembly of FIG. 8.

A fine tuning adjustment assembly 58 is disposed between rod 60 of the volumetric piston pump 34 and the common drive bar 43 of the pump drive cylinder 40 for additionally controlling stroke of the volumetric piston pump 34. As best seen in FIGS. 8 and 10, the fine tuning adjustment assembly 58 includes an adjustment block 62 coupled to rod 60. The block 62 has a window 64 therein, whereby the adjustment block 62 is attached to coupling 66 by connector 63 with a bushing 65. A scale 68 is disposed onto the adjustment block 62 adjacent the window 64. A nylon shoe 70 within the adjustment block 62 is viewed through the window 64 so that the scale 68 can be read from the top of the nylon shoe 70. A toggle shoe clamp 72 is threaded into bottom of the adjustment block 62 to raise and lower the nylon shoe 70 while a lock nut 74 is threadably disposed onto the toggle shoe clamp 72 for locking the setting of the nylon shoe 70.

This fine tuning adjustment assembly 58 works by creating a 'dead' space in the stroke length of the piston rod 60 so that even through the common drive bar 43 is moving up, no pumping of piston takes place while the 'dead' space is being closed up.

Figure 9:
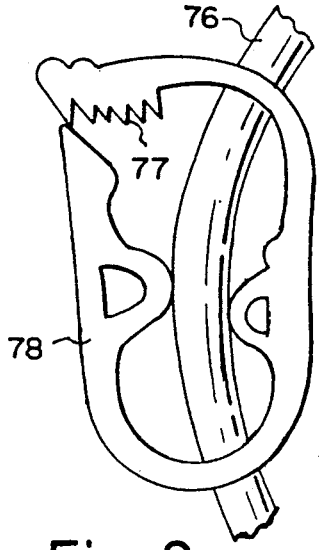
FIG. 9 is an enlarged view as indicated by numeral 9 in FIG. 7 showing the adjustable suck back clip in greater detail.

A suck back vacuum tube 76 is disposed into the tee fitting 50 to bypass the check valves 48 for preventing dripping of the fluid 18 from the nozzle 26 after feed stroke of the volumetric piston pump 34 is completed. An adjustable clip 78, as best seen in FIG. 9, is disposed onto the suck back vacuum tube 76 for controlling the flow of the fluid 18 back into the reservoir 16. The clamp has a series of notches 77. The more open the clamp 73 the more suck back vacuum is present.

Figure 4:
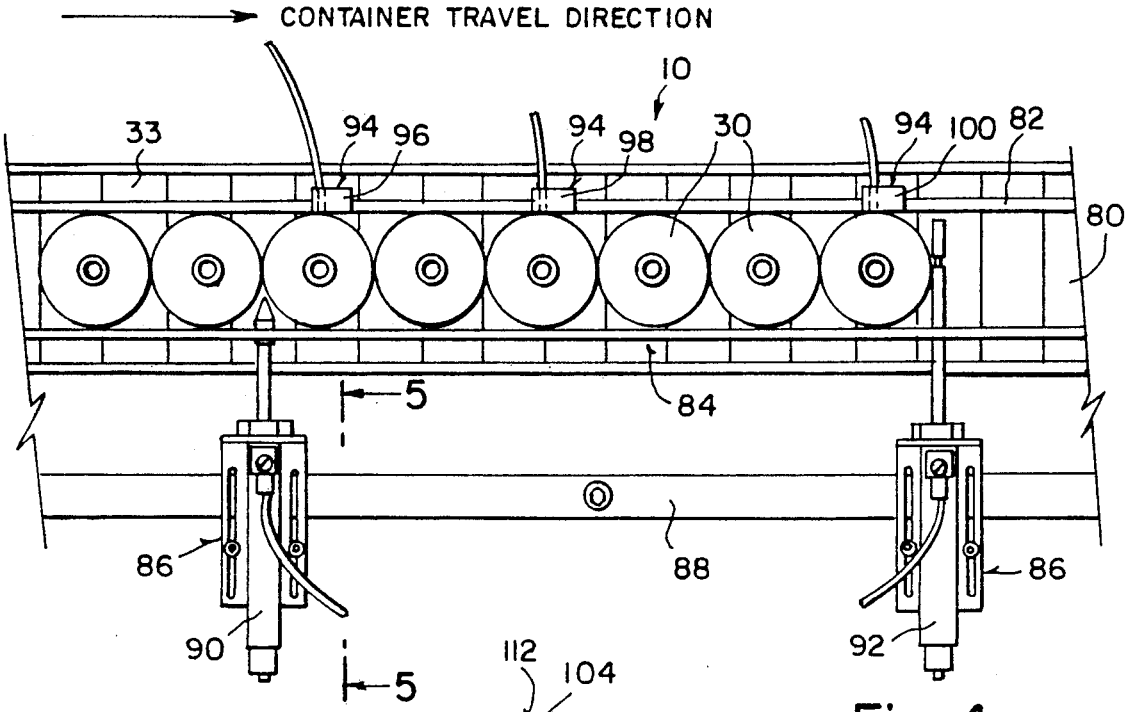
FIG. 4 is an enlarged top view with parts broken away showing the conveyorized filling area in greater detail.
Figure 5:
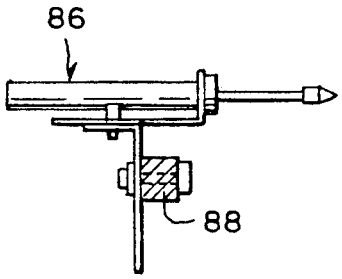
FIG. 5 is a cross sectional view taken along line 5—5 in FIG. 4, showing the incoming stop cylinder.

As best shown in FIGS. 4 and 5, the automatic conveying structure 33 includes a conveyor belt 80 having a guide rail 82 for carrying the containers 30 therealong to a filling area 84 between two pneumatic cylinder rods 90 and 92 which are spaced apart and adjustably mounted to the mounting rail 88 via mounting brackets 86. The first cylinder 90 is positioned to be an incoming stop cylinder, while the second cylinder 92 is positioned to be an exit stop cylinder at the filling area 84. Three fiber optic sensors 94 are spaced apart and adjustably mounted on the guide rail 82 of the conveyorized belt 80. The first fiber optic sensor 94 is positioned to be a 'full' photo-eye 96, the second fiber optic sensor 94 is positioned to be a 'space' photo-eye 98, while the third fiber optic sensor 94 is positioned to be an 'empty' photo-eye 100 at the filling area 84. The 'full' sensor acts as a feed back mechanism to automatically tell the programmable controller that the filling area 84 is full of containers 30 and it can proceed to fill. The 'space' photo eye 98 and the 'empty' photo eye 100 signal to the programmable controller where the containers 30 are to automatically feed the volumetric filler 10 with empty containers 30 and remove them once they are filled.

Figure 6:
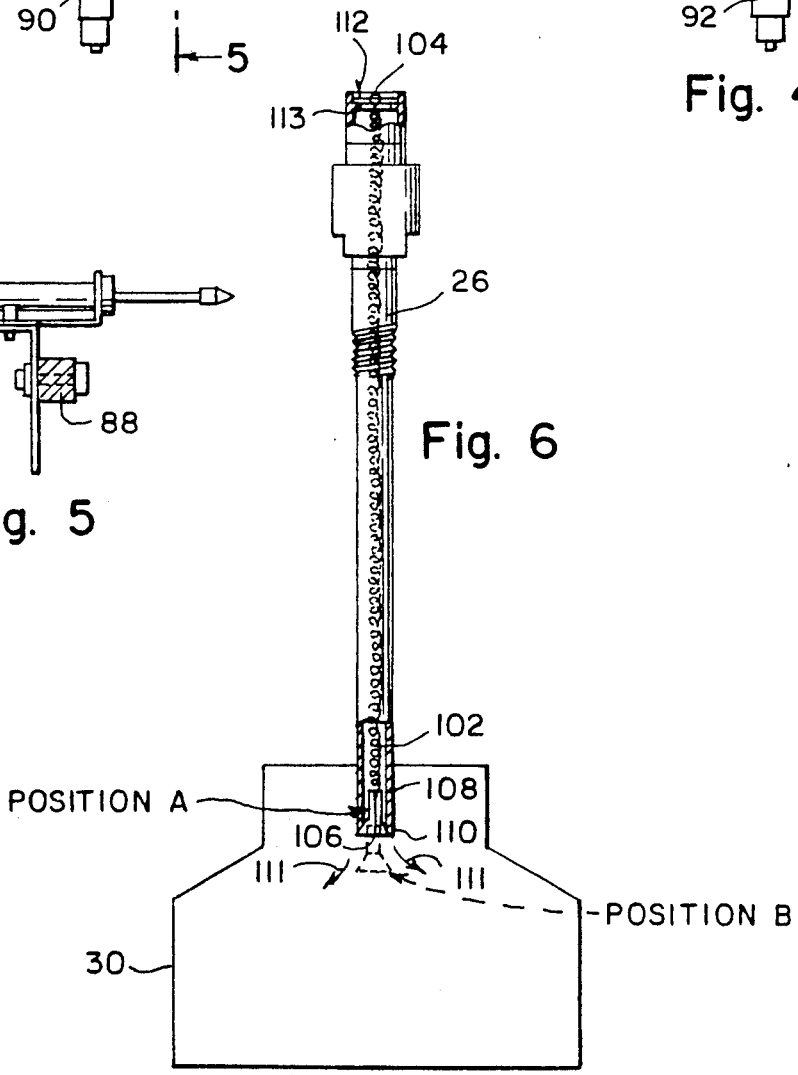
FIG. 6 is an elevational view with parts in section of the nozzle showing the no drip poppet.

The filler nozzle 26 shown in FIG. 6, is one example of a filling nozzle compatable with the filler 10. It includes an elongated spring 102 suspended at top end 104 within the filler nozzle 26. A poppet 106 is affixed to bottom end 108 of the spring 102 to form a positive cut-off no drip closed tip 110 on the filler nozzle 26. (Position A.)

When product (liquids) is dispensed from the nozzle 26 by the pumping action of the piston pump 34 it gets pushed through the tube 28 into the nozzle 26 which foces the spring 102 to stretch allowing the product 111 to move the poppet 106 down and allows the product to enter container 30. (Position B). After pumping, spring 102 returns to closed (Position A) preventing any product from leaking. Spring 102 is held in place on top of nozzle 26 by a thin rod 112 resting in groove 113 at nozzle top.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic conveyorized volumetric container filler which comprises:

(a) a reservoir of fluid;

(b) means for pumping the fluid out of said reservoir;

(c) means for controlling volume of the fluid pumped;

(d) means for preventing backflow of the fluid into said reservoir;

(e) a filling nozzle fluidly connected to said backflow preventing means including ducts connecting said reservoir, said pumping means, said backflow preventing means and said nozzle;

(f) a container for receiving the fluid from said filling nozzle;

(g) means for controlling height of said filling nozzle to compensate for varying heights of said container;

(h) means for automatically conveying a plurality of said containers to said filling nozzle for receiving the fluid therefrom so that after said containers are filled, they can be conveyed away to be capped; wherein said means for pumping includes:

(i) a support Frame;

(j) a volumetric piston pump having an upper end and a rod;

(k) a pump drive cylinder;

(l) a common drive bar connecting said pump drive cylinder and said volumetric piston pump; and (m) a linear bearing guide shaft slide assembly for said drive bar; wherein said volume controlling means includes:

(n) a pair of spaced apart sensor switches in which one of said sensor switches is adjustable with respect to other of said sensor switches; and (o) a pair of spaced apart actuators carried by said common drive bar to activate said sensor switches so as to limit stroke of said slide mount; wherein said adjustable switch is adjusted by a hand wheel and is mounted on said support frame and connected to a bracket on which said adjustable switch is mounted, wherein said backflow preventing means includes a pair of check valves within a tee fitting on said upper end of said volumetric piston pump, connecting said piston pump with the reservoir and filling nozzle via said ducts, wherein said height controlling means includes a vertical adjustable nozzle rack for holding said filling nozzle, further comprising a fine tuning adjustment means comprising a dead space disposed between said rod of said volumetric piston pump and said slide mount of said common drive bar for additionally controlling stroke of said volumetric piston pump, wherein said fine tuning adjustment means includes:

(a) an adjustment block having a window therein, said adjustment block coupled to said rod of said volumetric piston pump;

(b) a scale disposed onto said adjustment block adjacent said window;

(c) a nylon shoe within said adjustment block and viewed through said window so that said scale can be read from top of said nylon shoe;

(d) a toggle shoe clamp threaded into bottom of said adjustment block to raise and lower said nylon shoe; and (e) a lock nut threadably disposed onto said toggle shoe clamp for locking the setting of said nylon shoe.

2. An automatic conveyorized volumetric container filler as recited in claim 1, further comprising means for preventing dripping of the fluid from said filler nozzle after feed stroke of said volumetric piston pump is completed; wherein said dripping preventing means is a suck back vacuum tube disposed into said tee fitting to bypass said check valves; further comprising an adjustable clip disposed onto said suck back vacuum tube for controlling the flow of the fluid back into said reservoir.

3. An automatic conveyorized volumetric container filler as recited in claim 2, wherein said automatic conveying means includes:

(a) a conveyor having a guide rail for carrying said containers therealong to a filling area;

(b) two pneumatic cylinders, spaced apart and adjustably mounted to said conveyor, in which first of said cylinders is positioned to be an incoming stop cylinder while second of said cylinders is positioned to be an exit stop cylinder at the filling area; and (c) three fiber optic sensors spaced apart and adjustably mounted on said guide rail of said conveyor in which first of said fiber optic sensors is positioned to be a full photo-eye second of said fiber optic sensors is positioned to be a space photo-eye, while third of said fiber optic sensors is positioned to be an empty photo-eye at the filling area.

4. An automatic conveyorized volumetric container filler as recited in claim 3, wherein said filler nozzle includes:

(a) an elongated spring suspended at top end within said filler nozzle; and (b) a poppet affixed to bottom end of said spring to form a positive cut-off no drip closed tip on said filler nozzle.

* * * * *